United States Patent [19]

Ali

[11] 4,400,970

[45] Aug. 30, 1983

[54] METHOD OF AND APPARATUS FOR MEASURING IN SITU, THE SUB-SURFACE BEARING STRENGTH, THE SKIN FRICTION, AND OTHER SUB-SURFACE CHARACTERISTICS OF THE SOIL

[76] Inventor: Muhammad A. Ali, 10507 Odessa Dr., Sugar Land, Tex. 77478

[21] Appl. No.: 305,082

[22] Filed: Sep. 24, 1981

[51] Int. Cl.[3] ..... G01N 19/02; G01N 3/42

[52] U.S. Cl. ..... 73/9; 73/84

[58] Field of Search ..... 73/9, 84

[56] References Cited

U.S. PATENT DOCUMENTS

| | | | |
|---|---|---|---|
| 2,640,351 | 6/1953 | Jourdain | 73/84 |
| 3,906,781 | 9/1975 | Vlasblom | 73/84 |
| 3,968,682 | 7/1976 | Pellissier | 73/84 |
| 3,988,923 | 11/1976 | Elmiger | 73/84 |
| 3,999,424 | 12/1976 | Pellisier | 73/84 |
| 4,332,160 | 6/1982 | Baragar | 73/84 |

*Primary Examiner*—S. Clement Swisher

*Attorney, Agent, or Firm*—Vaden, Eickenroht, Thompson, Bednar & Jamison

[57] ABSTRACT

The invention disclosed includes a method of and apparatus for measuring the sub-surface bearing strength of soil and the frictional resistance of the soil to movement of a pile through the soil. A probe is used for this purpose that includes three relatively movable members, an inner plunger with a flat face, an inner tubular member, and an outer tubular member. By measuring the force required to move the members through the soil together and separately the bearing capacity and the skin friction of the soil can be calculated.

6 Claims, 33 Drawing Figures

FIG. 2B
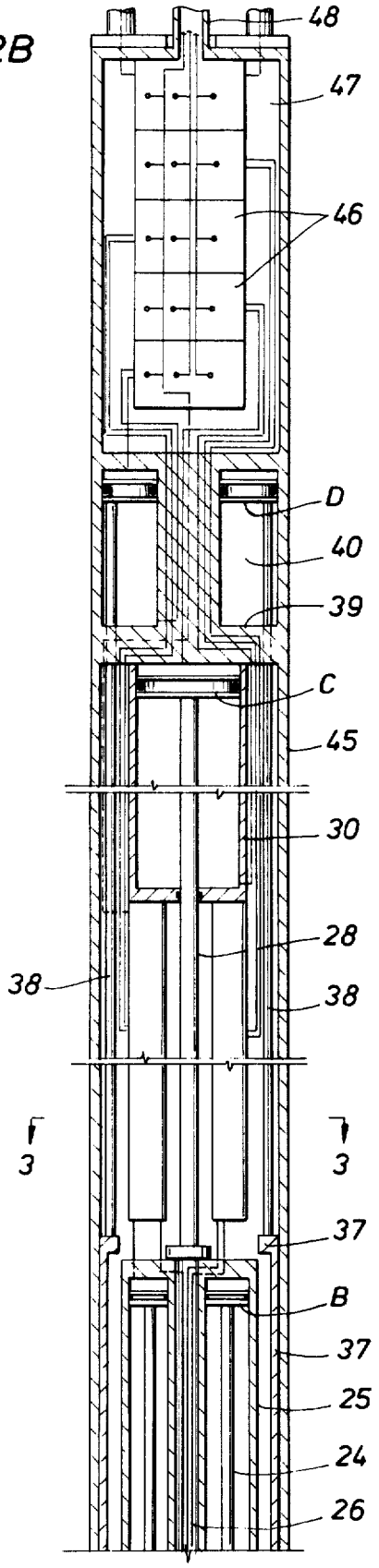
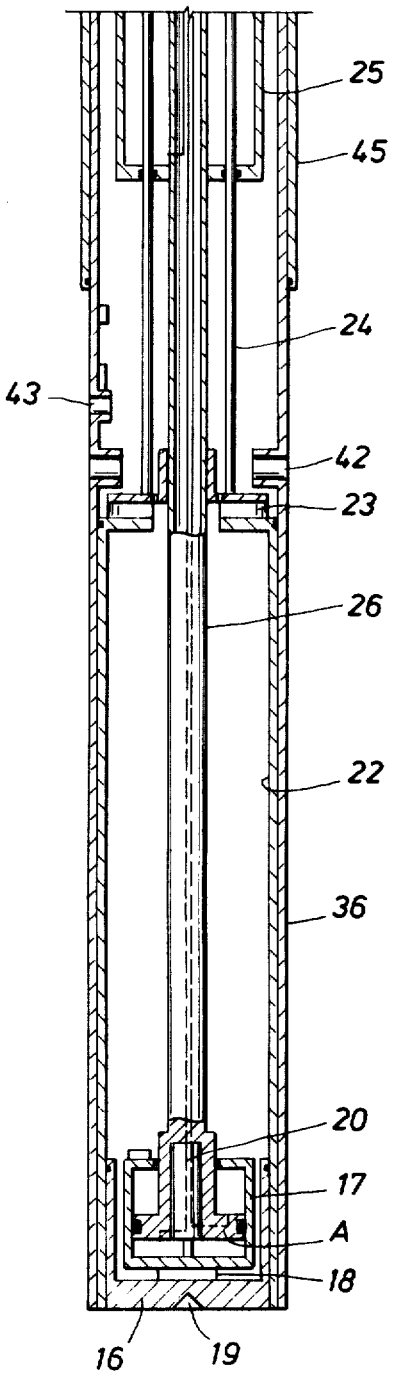
FIG. 2C

FIG. 11 MAXIMUM UNIT END BEARING VERSUS DEPTH CURVES FOR DETERMINATION OF SOIL DENSITY

FIG. 5A
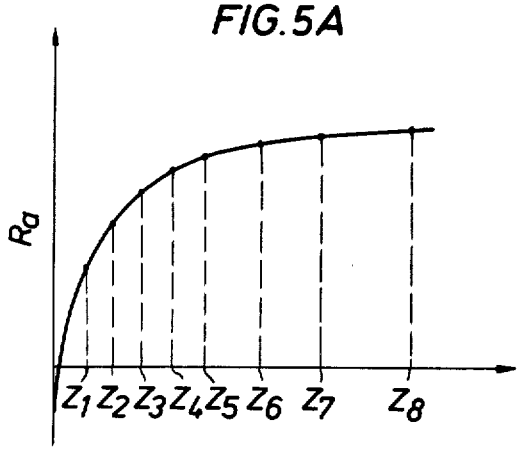
FIG. 5B
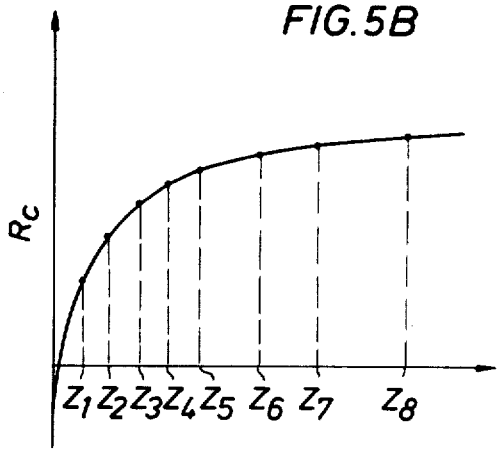
FIG. 5C
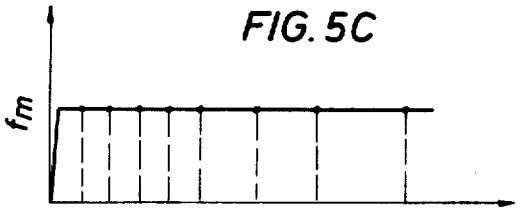
FIG. 5D
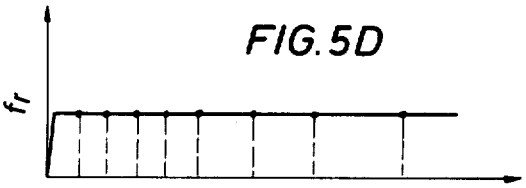
FIG. 5E
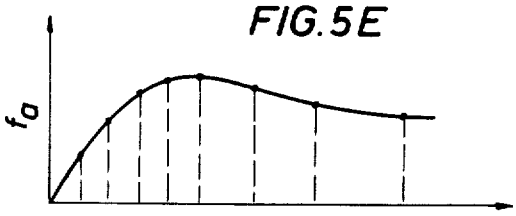
FIG. 5F
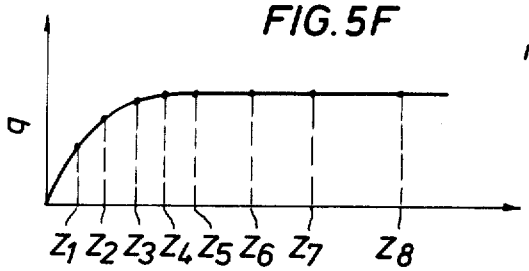
FIG. 9A
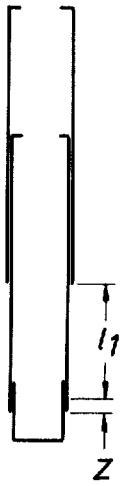
FIG. 9C
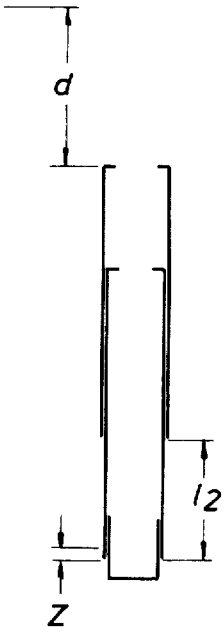
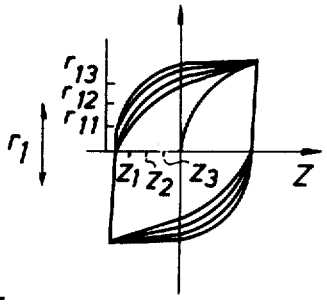
FIG. 9B
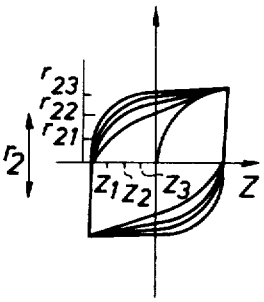
FIG. 9D

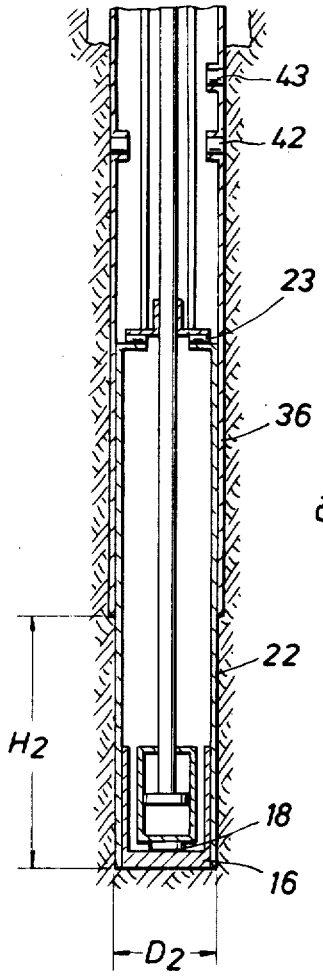
FIG. 6A
FIG. 6B
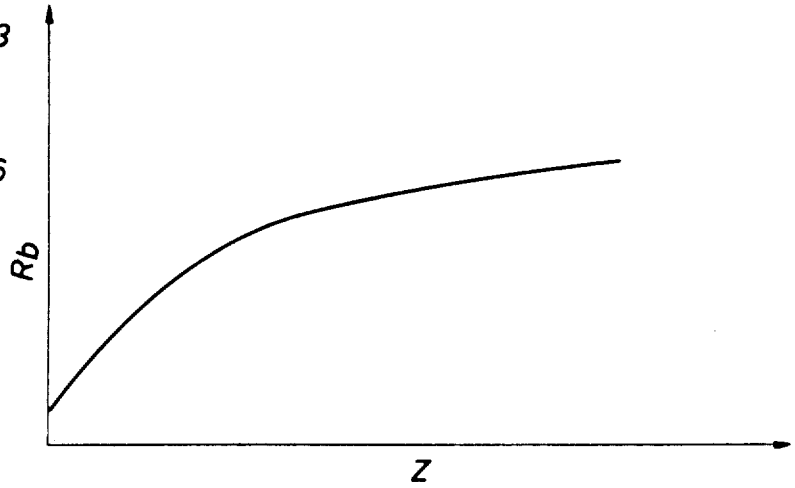
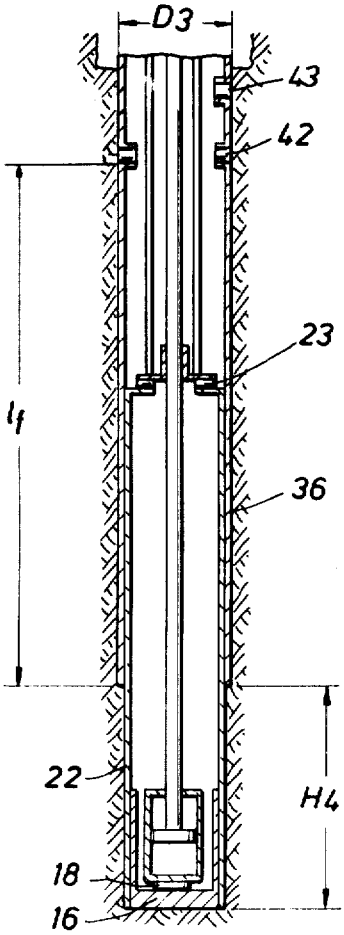
FIG. 7A
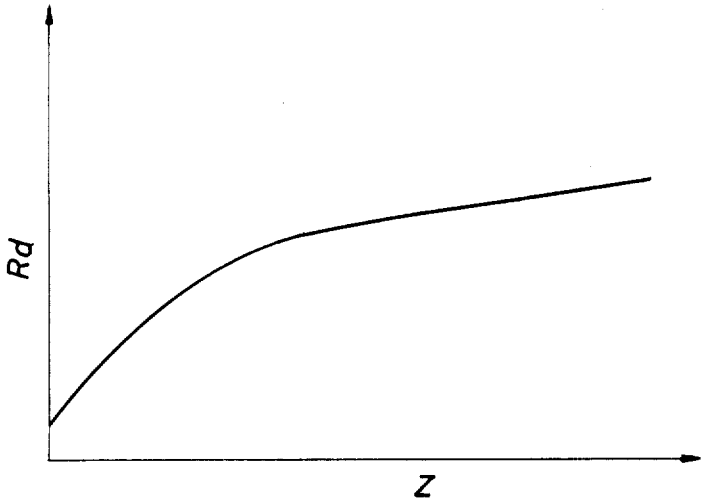
FIG. 7B

FIG. 12 FRICTION RATIO VERSUS ANGLE OF INTERNAL FRICTION CURVES
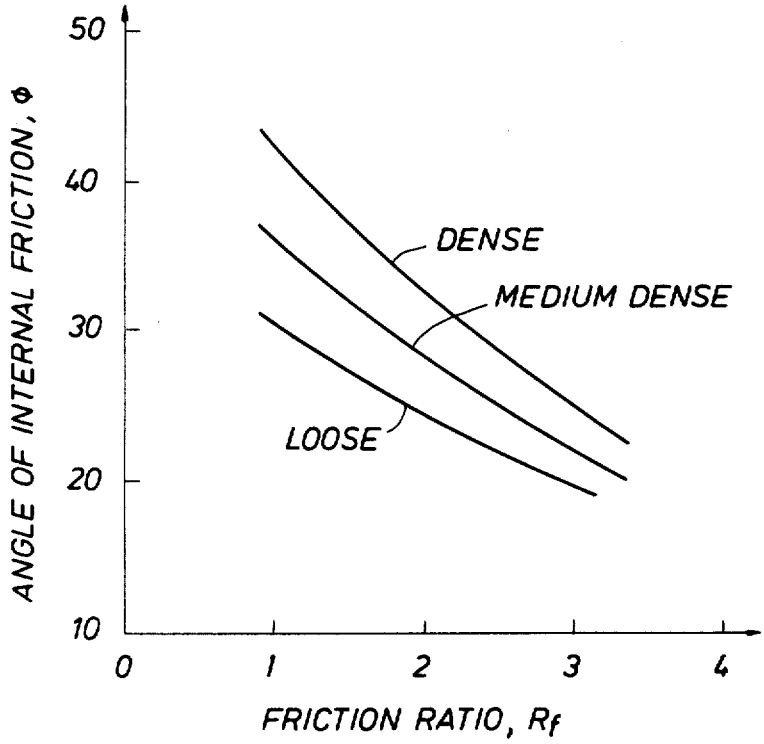
FIG. 13 MAXIMUM UNIT END BEARING VERSUS EFFECTIVE VERTICAL STRESS CURVES
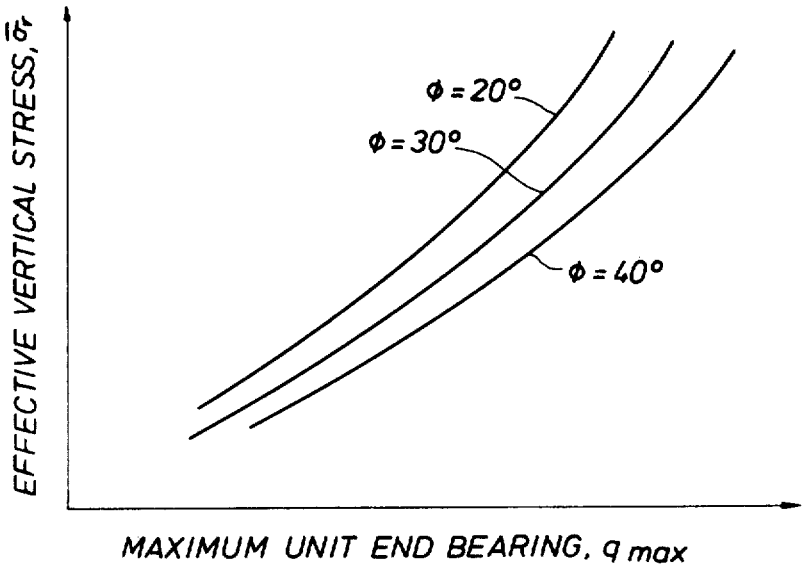

METHOD OF AND APPARATUS FOR MEASURING IN SITU, THE SUB-SURFACE BEARING STRENGTH, THE SKIN FRICTION, AND OTHER SUB-SURFACE CHARACTERISTICS OF THE SOIL

This invention relates generally to soil testing to obtain information useful in the design of a foundation so that it and the structure to be built on the foundation will be adequately supported by the soil. In one aspect, the invention relates to a method of and apparatus for measuring in situ such sub-soil characteristics as its sub-surface bearing strength and the frictional resistance of the soil to movement of a pile through the soil, commonly called skin friction. It is another aspect of this invention to provide a method of and apparatus for measuring the change in skin friction due to cyclic movement of a pile in the soil. It is yet another aspect of this invention to provide a method and apparatus for measuring the resistance of the soil to upward movement of a pile located in the soil.

The foundation for any structure should be designed with some adequate knowledge of the sub-surface conditions of the soil that is going to support the foundation and the structure to be placed on the foundation. The information about the soil is obtained by field and by laboratory testing of soil samples obtained by soil borings. The soil samples, however, are disturbed when they are removed from the ground and transported to a laboratory. Further, field conditions or in situ conditions of the soil cannot always be simulated in the laboratory.

Therefore, usually, some in situ tests are also conducted. These in situ probes measure some soil properties, such as shear strength, permeability, bearing capacity, and so forth which are mainly used for strategraphic correlations. Information thus obtained however, is not considered adequate for foundation design work, more information is desired. In particular, since the skin friction and the end bearing values of a pile are functions of pile movement, it is desirable that the variation of the soil resistance at the pile tip due to movement of the tip and the changes in skin friction due to pile movement be known by the foundation designer. At the present time, this information is obtained empirically based upon information obtained from the soil samples and test data and includes a substantial amount of personal judgement on the part of the person interpreting the information.

Therefore, it is an object of this invention to provide a method of and apparatus for obtaining information about the subsurface characteristics of a soil in situ from which the variation of resistance, q, at the pile tip due to tip movement, z, (q-z curve) can be obtained.

It is a further object of this invention to provide a method of and apparatus for obtaining accurate measurements of subsurface soil conditions in situ from which changes in compressive skin friction, f, due to pile movement, z (f-z curve) can be obtained.

It is further object of this invention to provide a method of and apparatus for obtaining subsurface soil information in situ from which an f-z curve for tension can be determined.

It is further object of this invention to provide a method of and apparatus for obtaining accurate measurements of the degredation of the skin friction offered by the soil due to cyclic loading of a pile located in the soil and other soil characteristics for design and stratigraphic correlations.

These and other objects, advantages, and features of this invention will be apparent to those skilled in the art from consideration of this specification including the attached drawings and appended claims.

IN THE DRAWINGS

FIG. 1 is a view partly in section and partly in elevation of the apparatus of this invention extending through a hollow core bit to engage the bottom of a well bore preparatory to testing subsurface characteristics of the soil in accordance with the method of this invention;

FIGS. 2A, 2B, and 2C are vertical sectional views taken through the preferred embodiment of the apparatus of this invention;

FIGS. 5A–5D are curves of measured information that are combined to obtain the q-z curve;

FIG. 5E is a curve which is generated along with the q-z curve to account for the side friction effects.

FIG. 5F is the q-z curve obtained from the measured information contained in the curves of FIGS. 5A–5D;

FIG. 6A shows the relative positions of the elements of the apparatus after making the initial measurement of subsurface soil conditions for obtaining the f-z curve;

FIG. 6B is a representative curve plotted from the information obtained by the step shown in FIG. 6A;

FIG. 7A shows the relative positions of the elements of the apparatus after they have been moved to obtain the second portion of information required to obtain the f-z curve;

FIG. 7B is a representative curve plotted from the information obtained by the step shown in FIG. 7A;

FIGS. 9A–9D shows the manipulation of the apparatus and the curves of information obtained by cyclic loading of the soil by the apparatus in this invention;

FIG. 11 is a family of curves showing the relationship of soil density to maximum unit end bearing and depth;

FIG. 12 is a family of curves showing the relationship of friction ratio to the angle of internal friction for different said densities; and FIG. 13 is a graph of the relationship between maximum unit end bearing and effective vertical stress for different angles of internal friction.

The apparatus of this invention can be used to measure sub-soil conditions by positioning the apparatus on the surface of the soil, anchoring the apparatus against upward movement, and causing the various elements of the apparatus to penetrate into the soil in the manner described below. Usually, however, a well bore will be drilled into the soil a pre-selected distance and the apparatus will operate through the drill pipe to measure the soil conditions directly below the bottom of the well bore.

Figure 1:
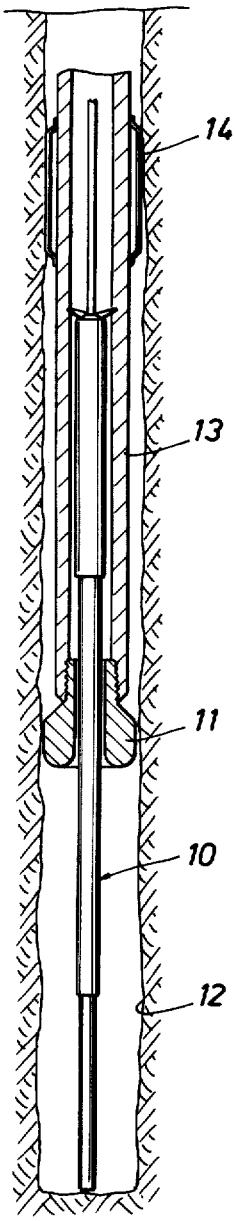

This is the arrangement shown in FIG. 1, where the apparatus, indicated generally by the numeral 10, extends through core bit 11 to engage the bottom of well bore 12. The core bit is attached to drill string 13, which in turn is supported by a core drilling rig located at the surface of the ground or on a ship or barge, if the soil being tested is below a body of water. Before the soil testing begins, the drilling rig raises core bit 11 from the bottom of the well bore. The apparatus of this invention is then lowered through the drill pipe into engagement with the bottom of the well bore as shown in FIG. 1. Stabilizer 14, or if desired an inflatable packer, is used to hold the drill pipe against lateral movement, which could disturb the operation of the apparatus and cause erroneous measurements to be made. Further, if the drill string is being supported from a floating vessel, unless the water is extremely smooth, a heave compensator of some type should be used to isolate the drill pipe from the vertical movement of the vessel due to waves.

Referring to FIG. 2C, the apparatus will be described from the bottom up. Generally, the apparatus is designed to provide three components that simulate the end or tip of a pile and the side of a pile. The components can be moved in the soil in various combinations to measure the resistance offered by the soil to different surface configurations from which the desired q-z and f-z curves can be obtained for the soil being tested.

In the embodiment shown, the apparatus includes five pistons located in five cylinders, each of which move various parts of the apparatus. All of the pistons are double-acting and in this embodiment they are powered by hydraulic fluid.

Located at the very bottom of the apparatus is cylindrical, cup-shaped plunger 16, which is geometrically similar to the tip of a pile. The plunger is connected to load cell 18, which is connected to cylinder 17. The cylinder supports both the load cell and the plunger for movement with the cylinder. Piston A is located inside cylinder 17. Hydraulic pressure below piston A will move the plunger downwardly; hydraulic pressure above piston A will move the plunger upwardly. Pressure transducer 19 is mounted in the flat circular face of the plunger. The distance the plunger moves away from and toward piston A is measured by displacement transducer, (LVDT) 20.

Plunger 16 is located in the open end of elongated cylindrical sample tube 22 which simulates the side of a pile upon which skin friction acts. The upper end of the sample tube is connected to load cell 23, which in turn is connected to a plurality of rods 24, the upper ends of which are connected to piston B, as shown in FIG. 2B. Piston B operates in annular cylinder 25 which surrounds and is connected to rod 26. Piston A is connected to the lower end of rod 26 so that movement of cylinder 25 will cause a corresponding movement in piston A.

Figure 3:
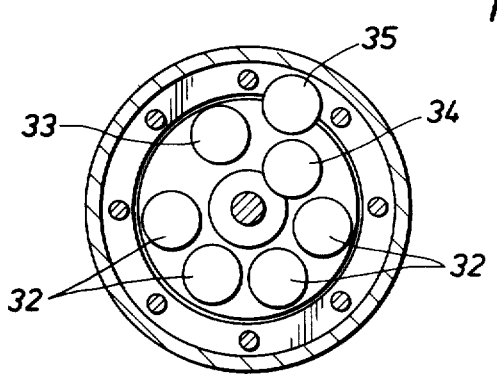
FIG. 3 is a cross-section taken on the lines 3—3 of FIG. 2B.
Figure 3:
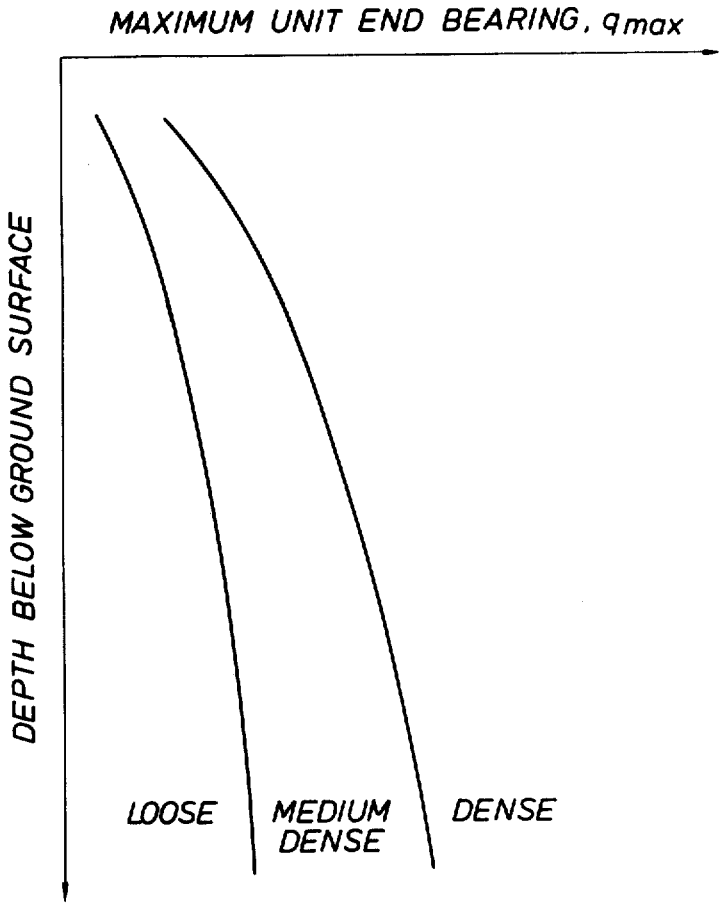
Figure 3A:
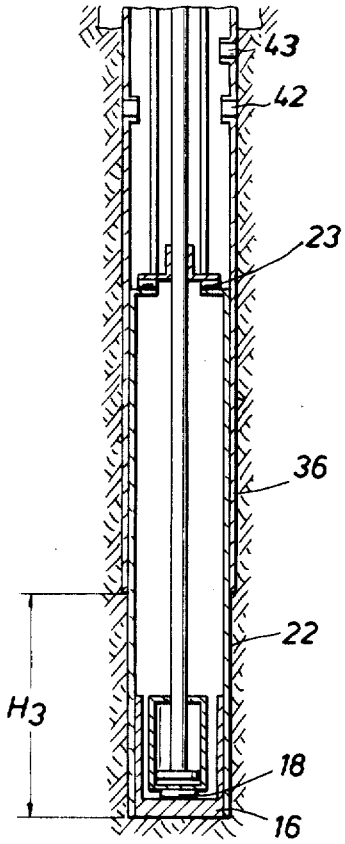
FIG. 3A is a cross sectional view of the lower portion of the apparatus showing the position of the relatively movable elements of the apparatus after the first measurements have been made for determining the q-z curve.

Piston rod 28 is connected at its lower end to the upper end of rod 26 and at its upper end to piston C, which is located in cylinder 30. As shown in FIG. 3, four slip joints 32 are located between cylinder 30 and the upper end of cylinder 25 through which the various hydraulic fluid conduits extend to the apparatus below. For clarity the electrical conduits serving the load cells, solenoid valves, displacement and pressure transducers have not been shown.

Again referring to FIG. 3, there are three displacement measuring transducers (LVDT) located side-by-side in this section of the housing. LVDT 33 has its lower end connected to the upper end of cylinder 25 and its upper end connected to cylinder 30 to measure the relative movement of the two cylinders. LVDT 34 is attached to the top of cylinder 25 with its movable rod connected to piston B to measure the movement of piston B relative to cylinder 25. LVDT 35 is connected to cylinder 30 with its lower end connected to cylinder 37 located above load cell 42. Friction sleeve 36 is positioned around sample tube 22 and is movable relative thereto by piston D. The upper end of cylinder 37 is connected to piston D by a plurality of rods 38 that have their upper ends connected to piston D and extend downwardly through cylinder head 39, which forms the lower end of cylinder 40 in which piston D operates. Load cell 42 is located at the upper end of the friction sleeve to measure the compressive and tensile forces imposed on the friction sleeve as it is moved up and down through the soil. Pressure transducer 43 is carried by cylinder 37 to measure the pore pressure of the soil adjacent the friction sleeve.

To summarize the apparatus at this point, piston A and cylinder 17 combine to move plunger 16 relative to sample tube 22 and friction sleeve 36. Piston B moves sample tube 22 relative to plunger 16 and friction sleeve 36. Piston C moves both plunger 16 and sample tube 22 relative to friction sleeve 36 and piston D moves the friction sleeve relative to both the sample tube and plunger 16.

This whole assembly is located in tubular housing 45. A plurality of solenoid operated valves 46 are positioned in chamber 47 in the upper end of housing 45. The valves are controlled from the surface electrically to direct hydraulic fluid to the cylinders to move the pistons to produce the relative movements of the plunger, sample tube, and friction sleeve described below to obtain the desired measurements. Hydraulic fluid under pressure is supplied from the surface through flexible conduit 48 located inside tubular conduit **48*a*. The electrical conductors required to operate the valves and transmit the measurements of the load cells and the displacement and pressure transducers to the surface are also located in conduit 48**.

Figure 2A:
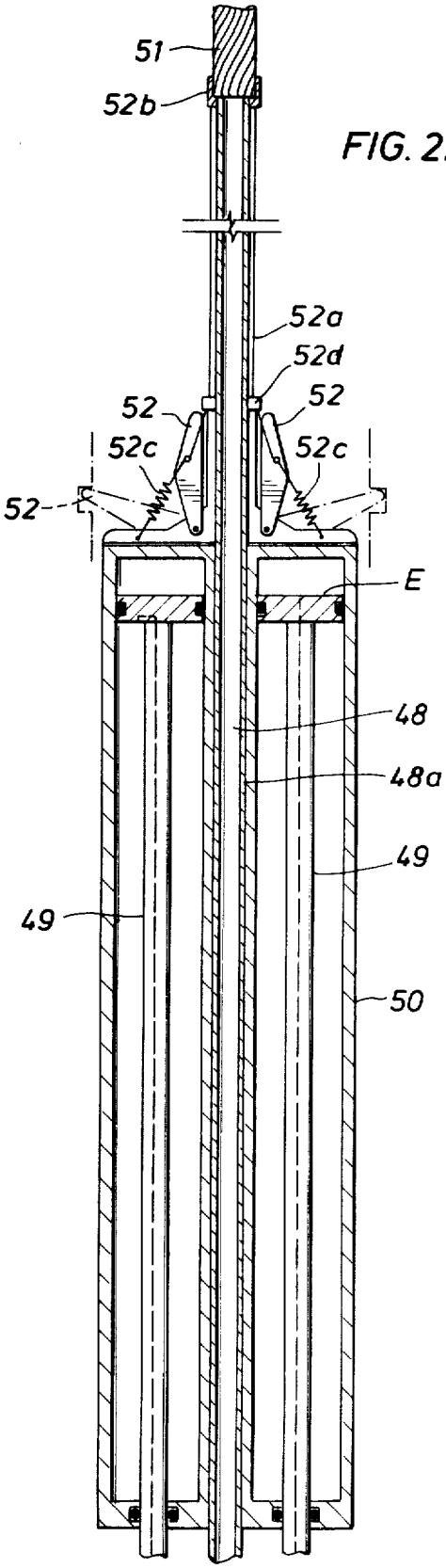

Housing 45 is connected to piston E, shown in FIG. 2A, by a plurality of piston rods 49 that extend through the lower end of cylinder 50 in which piston E is located. Cylinder 50 can slide up and down on relatively rigid conduit **48*a*, which is attached at its upper end to support cable 51 by collar 52*b*. Support cable 51 also provides a protective sheath to conduit 48** through which the electrical conductors and hydraulic conduits extend from the surface to the apparatus.

Located at the upper end of cylinder 50 are plurality of spring loaded dogs 52. When piston E is in its upper position, flexible lines **52*a*, each of which has one end connected to upper end 52b of conduit 48a and the other end to one of the dogs, will hold the dogs in the position shown. When the apparatus is resting on the bottom of a well bore, pressure applied to piston E will move the cylinder upwardly. This creates sufficient slack in lines 52a to allow the dogs to be pivoted outwardly by springs 52c into position to engage a groove (not shown) in the drill string to limit the upward movement of the cylinder. Lines 52a slide through guide holes provided in collar 52d**.

In operation, the apparatus is lowered through the drill string until its lower end is in engagement with the bottom of the well bore. Air or some other gas is supplied from the surface to maintain the pressure inside the apparatus equal to outside pressure. As hydraulic pressure is supplied above piston E to move the lower end of the apparatus, latches or dogs 52 are released as described above to limit the upward movement of the apparatus. As the upward movement is thus prevented the lower end of the apparatus including plunger 16, sample tube 22, and friction sleeve 36 is forced into the soil below the bottom of the well bore until pressure transducer 43 is below the lower end of the well bore.

As the apparatus is pushed into the soil for making in situ measurements, the soil resists such penetration and therefore becomes stressed. Before making any in situ measurements it is necessary to unload the soil by removing any end bearing and skin friction stresses that have been imposed on the soil. To unload the soil from end bearing a knowledge of effective vertical stress $\overline{\sigma}_v$ is needed. There can be a number of ways to estimate $\overline{\sigma}_v$. It is preferred that $\overline{\sigma}_v$ be estimated by the following procedure. It can be verified by other known methods if desired.

To unload a soil from end bearing in cohesive material such as clay, the apparatus is slowly pulled upwardly after insertion to the desired level. Whatever pore pressure was generated in the soil below during insertion, starts decreasing during upward movement. When the pore pressure measured by pressure transducer 19 becomes equal to the hydrostatic pressure at that level, the upward movement of the probe is stopped. The pressure, P, acting against the lower surface of plunger 16 is now equal to the total vertical stress in the soil at this level and therefore it is considered that the soil has been unloaded from end bearing stress. The pressure, P, the slope K of the unloading curve corresponding to this pressure and the upward movement $u_1$ needed to obtain P are recorded.

In granular material, such as sand, the unit end bearing is mainly dependent on the angle of internal friction and the effective vertical stress. Therefore, a family of curves can be generated relating unit end bearing with the angle of internal friction and effective vertical stress. During insertion of the probe, the maximum end bearing stress $q_{max}$, can be calculated using Equation 1 as follows:

$$q_{max}=(1/A_{pe})(LC_{18}+P_GA_{pn}+W_1+f_m\pi D_1l_p+f_r\pi D_1)-h\gamma_w \quad (1)$$

where, $A_{pe}$ = end area of plunger;
$A_{pn}$ = net area of plunger available to gas pressure;
$LC_{18}$ = reading of load cell 18;
$P_G$ = gas pressure;
$W_1$ = weight of plunger;
$f_m$ = unit metal to metal friction (determined in the laboratory during calibration of the equipment);
$f_r$ = friction per unit length of sealing ring (determined in the laboratory during calibration of the equipment)
$D_1$ = diameter of plunger;
$l_p$ = length of plunger;
h = depth below free water surface;
$\gamma_w$ = unit weight of water.

Once the value of $q_{max}$ is determined, the value of $f_{a\,max}$ can be obtained from Equation 2 and the soil consistency can be assessed from FIG. 11.

$$f_{a\,max}=(1/\pi D_3l_f)\{LC_{18}+LC_{23}+LC_{42}-P_G(A_{fn}+A_{sn}-A_{pn})+(W_1+W_2+W_3)-(\pi/4)D_3^2q_{max}\} \quad (2)$$

where, $D_3$ = outer diameter of friction sleeve;
$LC_{18}, LC_{23}, LC_{42}$ = readings of load cells 18, 23 and 42;
$A_{fn}, A_{sn}$ = areas of friction sleeve and sampler tube available to gas pressure;
$W_1, W_2, W_3$ = weights of plunger, sampler tube and friction sleeve;
$l_f$ = length of friction sleeve.

With the value of friction ratio, $R_f\% = (f_{a\,max}/q_{max}) \times 100$ and soil consistency thus known, the angle of internal friction, Φ, can be obtained from FIG. 12. The effective vertical stress $\overline{\sigma}_v$ can now be determined from FIG. 13 as both Φ and $q_{max}$ are known.

After determination of $\overline{\sigma}_v$ the apparatus is slowly moved upward by operating piston-E till the reading of load cell 18 is given by Equation 3.

$$LC_{18}=(\overline{\sigma}_v+h\gamma_w)A_{pe}-(P_GA_{pn}+W_1+f_m\pi D_1l_p+f_r\pi D_1) \quad (3)$$

At this position, the pressure, P, acting at the bottom of the plunger is equal to the total vertical stress in the soil. Thus, the soil is unloaded from end bearing stress that resulted from the insertion of the apparatus. The pressure P, the slope K of the unloading curve corresponding to this pressure, and the upward movement $u_1$ needed to obtain P are recorded.

To eliminate any skin friction that might be acting on the friction sleeve, piston D is operated and the readings of load cell 42 and the corresponding displacements given by LVDT 35 are recorded.

The condition of zero skin friction is obtained when Equation 4 is satisfied.

$$LC_{42}=P'A_{fe}+P_GA_{fn}+f_m\pi D_2l_s+f_r\pi D_2-W_3 \quad (4)$$

where, $LC_{42}$ = reading of load cell 42;
$P'=P+Kz$ and z is positive downward;
z = additional movement needed to eliminate skin friction;
$A_{fe}$ = end area of friction sleeve;
$A_{fn}$ = net area of friction sleeve available to gas pressure;
$D_2$ = outside diameter of sampler tube;
$l_s$ = length of sampler tube;
$W_3$ = weight of friction sleeve.

The net upward movement of friction sleeve $u_2$ needed to eliminate side friction is also recorded.

DETERMINATION OF q-z CURVE

For this measurement sampler tube 22 and plunger 16 are moved first. Before this movement, load cells 18 and 23 should have the following initial readings.

$$IR_{18}=0 \quad (5)$$

$$IR_{23}=-\pi D_2(f_m l_2+f_r) \quad (6)$$

where, $D_2$=outer diameter of sampler tube;

$l_s$=length of sampler tube;

fm=unit metal to metal friction, (premeasured)

fr=friction per unit length of sealing ring, (premeasured)

Figure 3B:
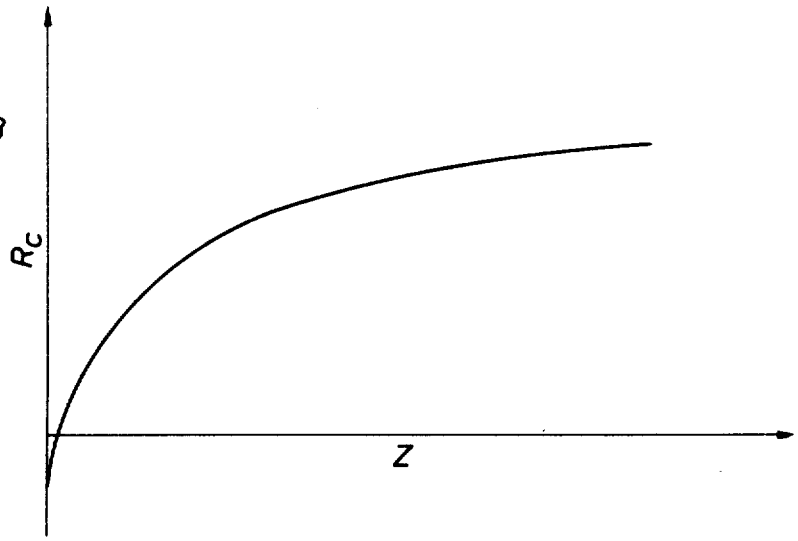
FIG. 3B is a representative curve plotted from the first measurements obtained by the relative movement of the elements shown in FIG. 3A.

After initializing the load cells, piston C is slowly advanced to move the sampler tube and the plunger a few inches into the soil. The soil resistance Rc is measured by the combined readings of load cells 18 and 23, while the correponding displacement is given by LVDT 33. This information is stored in a magnetic tape and is recorded by the X-Y plotter at the surface. The information measured follows a curve such as shown in FIG. 3B.

Soil under the probe is then unloaded by operating piston C to move the plunger and sampler tube upwardly by an amount equal to $u_1$. To eliminate side friction the net upward movement of the sampler tube should be $u_2$. Load cell 18 is now initialized as per Equation 7.

$$IR_{18}=-\pi D_1(f_m l_p+f_r) \quad (7)$$

where, $D_1$=outer diameter of plunger.

Figure 4B:
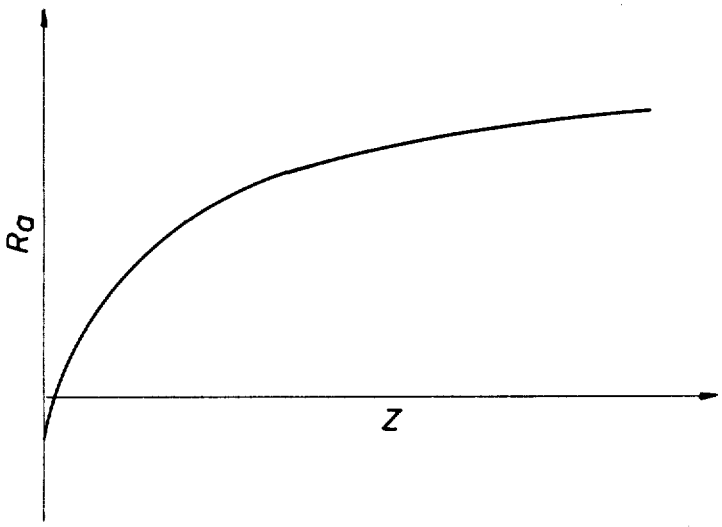
FIG. 4B is a representative curve plotted from the measurements obtained in this step.
Figure 4A:
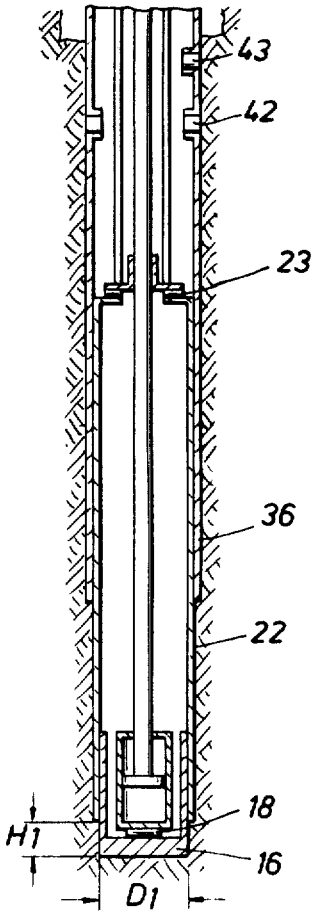
FIG. 4A shows the positions of the elements of the apparatus after it has made another measurement for use in obtaining the q-z curve.
Figure 8A:
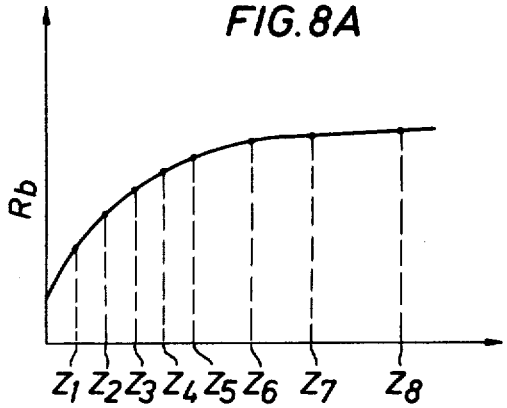
FIGS. 8A–8D are curves of measured information that are combined to obtain the f-z curve.
Figure 8B:
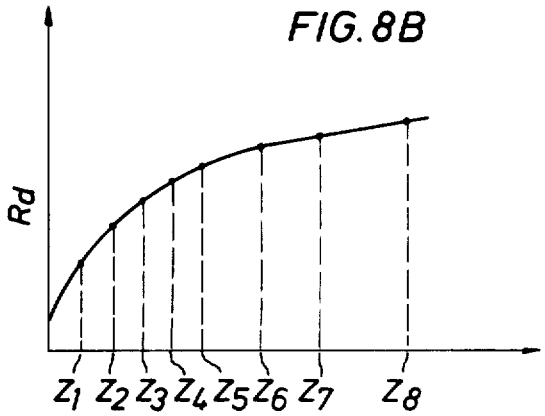
Figure 8C:
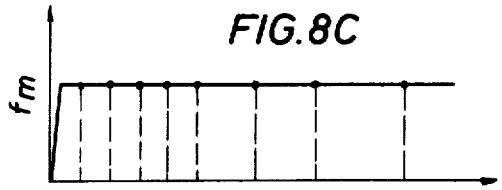

To move the plunger downwardly, piston A is activated and the resistance toward movement, $R_a$, is measured by load cell 18, while the corresponding displacement is measured by LVDT 20. The resistance and movement data are stored in a magnetic tape and also recorded by the X-Y plotter. This information measured follows a curve such as shown in FIG. 4B.

For any particular movement, $z_k$, the resistances $R_{ak}$ and $R_{ck}$ are combinations of the following quantities (FIGS. 5C-5F).

$f_m$=unit metal to metal friction;

$f_r$=friction per unit length of sealing ring;

$f_a$=unit soil to metal friction which is affected by end bearing;

q=unit mobilized end bearing.

therefore, correponding to movement $z_1$, $$R_{a1}=\pi D_1\left\{(l_p-z_1)f_m+f_r+\frac{1}{2}\left(z_1 f_{a1}+\frac{D_1 q_1}{2}\right)\right\} \quad (8)$$

$$R_{c1}=\pi D_2\left\{(l_s-z_1)f_m+f_r+\frac{1}{2}\left(z_1 f_{a1}+\frac{D_2 q_1}{2}\right)\right\} \quad (9)$$

where, $D_1$=outside diameter of the plunger;

$D_2$=outside diameter of the sample tube;

$l_s$=length of sample tube; and $l_p$=length of plunger.

Solving the above two equations simultaneously the two unknowns $f_{a1}$ and $q_1$ can be determined.

Similarly, corresponding to movemement $z_2$, $$R_{a2}=\pi D_1\left\{(l_p-z_2)f_m+f_r+\frac{1}{2}z_2 f_{a1}+\frac{1}{2}(z_2-z_1)f_{a2}+\frac{D_1 q_2}{4}\right\} \quad (10)$$

$$R_{c2}=\pi D_2\left\{(l_s-z_2)f_m+f_r+\frac{1}{2}z_2 f_{a1}+\frac{1}{2}(z_2-z_1)f_{a2}+\frac{D_2 q_2}{4}\right\} \quad (11)$$

In Equations 10 and 11, the value of $f_{a1}$ is already known from Equations 8 and 9. As such, the remaining unknowns $f_{a2}$ and $q_2$ can be determined. This way considering the successive movements $z_3$, $z_4$, $z_5$, etc., the fa-z curve of FIG. 5E and the q-z curve of FIG. 5F can be generated. In view of the very little difference between $D_1$ and $D_2$, it is considered adequate to correspond both $R_a$ and $R_c$ with the same q-z curve. For standardization, however, the z-axis of the q-z curve should be normalized with the average of the two diameters $D_1$ and $D_2$.

DETERMINATION OF f-z CURVE (COMPRESSION)

After measuring $R_a$, piston A is operated to move the plunger upwardly to unload the soil. The plunger should move by an amount equal to $u_1$. Prior to the measurement of skin friction, soil around the probe should consolidate. This is indicated by the pore pressure transducer 43. The time elapsed between insertion of the probe in the soil and dissipation of most of the excess pore pressure is noted and this much time is allowed between the movement to measure $R_c$ and any movement to determine the f-z curve.

The reading of load cell 23 is now initialized according to Equation 12.

$$IR_{23}=\pi D_1\{f_m(l_p-H_1+u_1)+f_r\}+\pi D_2\{f_m(l_s-H_3+u_2)+f_r\} \quad (12)$$

where, $H_1$=distance the plunger extends below the sample tube; and $H_3$=distance the sample tube extends below the friction sleeve.

The sample tube is then slowly pushed downward with the help of piston B. The resistance against movement, $R_b$, is obtained through load cell 23, while the corresponding movement z is given by LVDT 34. These data are then stored in a magnetic tape and also recorded on the X-Y plotter. The measured information follows the curve shown in FIG. 6B.

To unload the soil around the sampler tube, piston B is retracted by an amount equal to $u_2$. Load cell 42 is now initialized to the value given gy Equation 13.

$$IR_{42}=\pi D_2\{f_m(l_s-H_2+u_2)+f_r\} \quad (13)$$

where $H_2$ is as shown in FIG. 6A. To move the outer friction sleeve, piston D is advanced and the resistance to movement, $R_d$, is given by load cell 42 while the correponding movement is measured by LVDT 35. This information is then stored on a magnetic tape and also recorded by the X-Y plotter. A representative curve of this information is shown in FIG. 7B.

In this case the resistances $R_{bk}$ and $R_{dk}$ corresponding to any movement $z_k$ are combinations of the following quantities, FIGS. 8C–8F.

$f_m$ = unit metal to metal friction;

$f_r$ = friction per unit length of sealing ring;

f = unit skin friction;

$q_a$ = unit mobilized end bearing of an annular footing.

Corresponding to movement $z_1$, $$R_{b1}=\pi D_1\{(l_p-(H_1-u_1)+z_1)f_m+f_r\}+\pi D_2\{(l_s-(H_3-u_2)-z_1)f_m+f_r+f_1(\tfrac{1}{2}z_1+(H_3-u_2))\}+q_{a1}(\pi/4)(D_2^2-D_1^2) \quad (14)$$

$$R_{d1}=\pi D_2\{(l_s-(H_2-u_2)+z_1)f_m+f_r\}+\pi D_3 f_1\{\tfrac{1}{2}z_1+(l_f-z_1)\}+q_{a1}(\pi/4)(D_3^2-D_2^2) \quad (15)$$

where $D_3$, $l_f$, $H_1$, $H_2$, and $H_3$ are as shown in FIGS. 3A, 4A, 6A and 7A. The two unknowns $f_1$ and $q_{a1}$ can be determined by simultaneously solving Equations 14 and 15.

Similarly corresponding to movement $z_2$, $$R_{b2}=\pi D_1\{(l_p-(H_1-u_1)+z_2)f_m+f_r\}+\pi D_2\{(l_s-(H_3-u_2)-z_2)f_m+f_r+\tfrac{1}{2}f_1z_2+ +f_2((H_3-u_2)+\tfrac{1}{2}(z_2-z_1))\}+q_{a2}(\pi/4)(D_2^2-D_1^2) \quad (16)$$

$$R_{d2}=\pi D_2\{(l_s-(H_2-u_2)+z_2)f_m+f_r\}+\pi D_3\{\tfrac{1}{2}f_1z_2+f_2(l_f-\tfrac{1}{2}(z_1+z_2))\}+q_{a2}(\pi/4)(D_3^2-D_2^2) \quad (17)$$

With the values of $f_1$ and $q_{a1}$ known from Equations 14 and 15 the remaining unknowns $f_2$ and $q_{a2}$ can be determined. Therefore, considering the successive movements $z_3$, $z_4$, $z_5$, etc. the f-z curve of FIG. 8E and the qa-z curve of FIG. 8F can be generated.

DETERMINATION OF f-z CURVE (TENSION)

To unload the soil after measurement of $R_d$, the friction sleeve is slowly moved upward by the amount $u_2$. Soil around the apparatus is now allowed to consolidate and load cell 23 is initialized according to Equation 18.

$$IR_{23}=\pi D_1(f_m l_p+f_r)-\pi D_2\{f_m(l_s-H_4-u_2)+f_r\} \quad (18)$$

For measurenent of soil response, piston B is slowly retracted. The movement in this case is measured by LVDT 33 and the resistance to upward movement of the sample tube, $R_b'$, is given by load cell 23. These measurements are stored in a magnetic tape and then recorded by the X-Y plotter. To unload the soil around the sample tube, it is moved downward by $u_2$. Load cell 42 is now initialized in accordance with Equation 19.

$$IR_{42}=\pi D_2\{f_m(l_s-H_5)+f_r\} \quad (19)$$

where $H_5$ is the length of sample tube in contact with soil after the movement $u_2$. The friction sleeve is then pulled upward by operating piston D. Here the movement is given by LVDT 35 and the resistance to upward movement, $R_d'$, is measured by load cell 42. As before these measurements are stored in a magnetic tape and then recorded by the X-Y plotter.

Using the information on the variation of $R_b'$ and $R_d'$ with movement z and following the same procedure as f-z curve (compression), the required f-z curve (tension) can be developed; however, in this case instead of end bearing component ($q_a$-z curve, FIG. 8F), a suction component (S-z curve) is to be considered.

Cohesive soil is nonlinearly viscoelastic. Modulus degradation of such material depends mainly on the rate of loading, number of cycles and amplitude of strain. By controlling the flow of hydraulic oil in a piston, the rate of loading and the amplitude of strain can be changed.

For cyclic testing, plunger 16 is first advanced a short distance and then the whole probe is pushed downward in undisturbed soil. The plunger and the sample tube is now moved downward so that a considerable amount of the outside surface area of the sample tube comes in contact with the soil (FIG. 9A). Unloading of the soil is to be done by moving the different parts of the probe as before. To unload the soil below the plunger it should move upward by an amount equal to $u_1$. To remove any skin friction acting on the sample tube, it is slowly moved up by an amount $u_2$. The soil around the probe is now allowed to consolidate and the reading of load cell 23 is adjusted to zero. The valve controlling the flow of hydraulic fluid to piston B is now operated to impart cyclic motion to piston B, which moves the sample tube up and down, according to predetermined rate and amount of movement. The resistance versus movement curves (FIG. 9B) for both downward and upward movements are recorded at the end of any desired number of cycles.

Next the friction sleeve is pushed downward to some extent to reduce the exposed surface area of the sample tube. Then the whole probe is again moved downward a distance d (FIG. 9C) so that the sample tube is placed in undegraded soil. The soil around the probe is unloaded in the same way as before and is allowed to consolidate. The sample tube is now moved up and down for the same amplitude and rate of movement as before and the resistance versus movement curves recorded (FIG. 9D). Therefore, for each way movement and for any particular cycle, the variation of degraded skin friction with movement can be quantified as follows:

$$f_j=\frac{r_{1j}-r_{2j}}{\pi D_2(l_1-l_2)}+f_m \quad (20)$$

Here, $f_j$ = degraded skin friction at movement $z_j$.

$r_1$, $r_2$, $l_1$ and $l_2$ are as shown in FIGS. 9A–9D. The whole curve is generated as j is varied to cover the entire strain amplitude.

Granular soils are prone to liquefaction due to cyclic loading. To study the liquefaction potential of such soil around the probe, the friction sleeve is set in cyclic motion and the increase in pore pressure due to cyclic loading is monitored by pressure transducer 43.

After completion of all in situ tests, a soil sample is collected by pushing the sample tube all the way by piston B.

As stated above the apparatus can be used without a borehole. In this case piston E and cylinder 50, with the latching device are not used and the flexible cable is run through a hollow pushing rod. The surface electronics and other modules are housed inside a truck. A pushing mechanism from inside the truck pushes the rod. The weight of the truck is used as a counterweight.

The information obtained by the apparatus and method of this invention is directly applicable to the design of pile foundations. In addition, however, the following information can be obtained from this invention, which can be used along with laboratory test results to gain more insight about the subsurface conditions.

(i) Shear strength—The shear strength of cohesive soil can be approximated from the relationship, $$S_u = q_{max}/N_c$$

where, $S_u$ = undrained shear strength;

$q_{max}$ = maximum unit end bearing;

$N_c$ = bearing capacity factor.

(ii) Overconsolidation ratio—Correlation between $S_u/\bar{\sigma}_v$ and OCR has been established and the information is available in the literature. Therefore, knowing the undrained shear strength, $S_u$ and the effective overburden pressure, $\bar{\sigma}_v$, overconsolidation ratio can be approximated.

(iii) Stratigraphy—Reasonable stratigraphic correlations can be made from friction ratio data.

$$\text{Friction Ratio, } R_f(\%) = (f_{a\ max}/q_{max}) \times 100$$

In general as the friction ratio increases solids grade from coarser to finer grained materials.

(iv) Angle of internal friction—The angle of internal friction, Φ, which is the most important parameter of granular soil, can be estimated from correlations between Φ and $R_f$.

(v) Permeability—The dissipation of excess pore pressure in cohesive material as indicated by pressure transducer 43 provides qualitative information regarding permeability.

Figure 10:
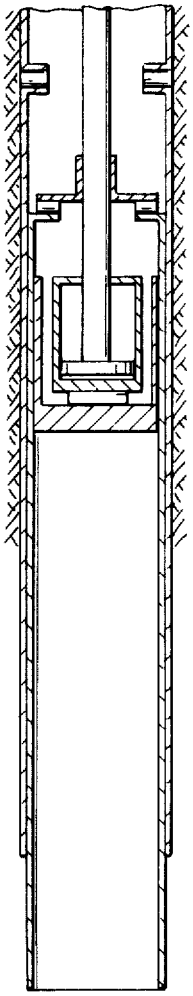
FIG. 10 shows the position of the elements of the apparatus when used to determine the effects on the f-z curve of partial soil displacement.
Figure 8D:
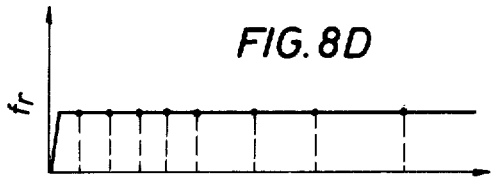
Figure 8E:
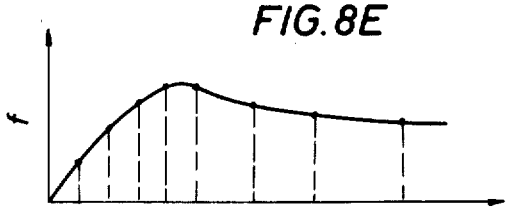
FIG. 8E is representative of the f-z curve obtained from the information shown in the curves in FIGS. 8A–8D.
Figure 8F:
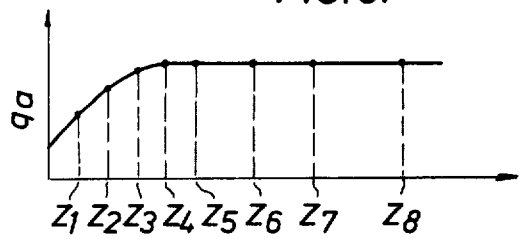
FIG. 8F is a curve generated along with the f-z curve to account for the end bearing effects during the necessary movements.

The apparatus can also be used to study the difference in skin friction between a low displacement and a full displacement pile (FIG. 10).

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A method of determining the bearing capacity and the skin friction of a soil in situ, comprising the steps of pushing a probe into the soil to the desired depth, said probe having three relatively movable, concentric, members with the center member comprising a plunger having a flat face for exerting a downward force in the soil across the area of the flat face, an inner tubular member, and an outer tubular member, measuring the pore pressure of the soil ahead of the probe, raising the probe until the pressure acting on the flat face of the plunger equals the pressure of the overburden to remove the stress created in the soil by the insertion of the probe, moving the outer tubular member to eliminate skin friction forces on the member, measuring the net movement of the probe and the outer tubular member required to eliminate soil stress, moving the plunger and inner tubular member downwardly into the soil below the probe, measuring the soil resistance to such movement over a given distance to obtain a force vs distance curve, moving the plunger and inner tubular member upwardly the predetermined distance required to relieve the stress in the soil, moving the plunger downwardly into the soil a preselected distance measuring the force required to obtain a force vs distance curve for the plunger, and calculating the actual soil end bearing resistance and skin friction from the two curves and known values of metal-to-metal and seal friction.

2. The method of claim 1 with the additional steps of moving the inner tubular member downwardly through the soil to the depth of the plunger and plotting the force vs distance curve for the movement, moving the outer tubular member downwardly a preselected distance and plotting the force vs distance curve for the movement, and calculating the actual skin friction of the soil from the two curves and known values of metal-to-metal and seal friction.

3. The method of claim 2 with the additional steps of exposing a portion of the inner tubular member to the soil in an unstressed state, moving the member up and down a predetermined rate and distance and recording the forces required for such movement, moving the outer tubular member relative to the inner member to change the length of the inner member exposed to the soil, repositioning the inner member in unstressed soil, moving the member up and down repeatedly said same rate and distance, recording the force required, using the difference in the measured forces to determine the degradation of the skin friction with cyclic motion.

4. Apparatus for obtaining values from which the actual bearing strength of the soil can be determined, comprising two concentric telescoping tubular members and a plunger member located in the lower end of the inner tubular member, means for moving the tubular members and the plunger relative to each other, means for measuring the force required to move each member separately, means for measuring the distance each member is moved, and means for measuring pore pressure at selected locations on said plunger and tubular members.

5. Apparatus for collecting information on subsoil characteristics to determine the variations in resistance, q, at a pile tip due to pile movement, z, comprising means for simulating the tip of a pile and means for simulating the side of a pile, means for moving the tip simulating means and the side simulating means together and separately into the soil to measure the resistance of the soil to movement of a pile and the skin friction of the soil from which the q-z curve can be calculated.

6. The apparatus of claim 5 further provided with a second means for simulating the side of a pile and means for moving the first side simulating means relative to the second side simulating means and means for moving the second side simulating means relative to the first side simulating means to obtain measurements of skin friction from which the changes in skin friction f due to pile movements z can be calculated.

* * * * *